US009638013B2

(12) United States Patent
Yeh et al.

(10) Patent No.: US 9,638,013 B2
(45) Date of Patent: May 2, 2017

(54) APPARATUS AND METHODS FOR WELL CONTROL

(71) Applicants: Charles S. Yeh, Spring, TX (US); Tracy J. Moffett, Sugar Land, TX (US); John S. Sladic, Katy, TX (US); Christopher A. Hall, Cypress, TX (US); Stephen McNamee, Houston, TX (US)

(72) Inventors: Charles S. Yeh, Spring, TX (US); Tracy J. Moffett, Sugar Land, TX (US); John S. Sladic, Katy, TX (US); Christopher A. Hall, Cypress, TX (US); Stephen McNamee, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 549 days.

(21) Appl. No.: 14/188,568

(22) Filed: Feb. 24, 2014

(65) Prior Publication Data

US 2014/0262322 A1 Sep. 18, 2014

Related U.S. Application Data

(60) Provisional application No. 61/798,717, filed on Mar. 15, 2013.

(51) Int. Cl.
*E21B 43/08* (2006.01)
*E21B 34/08* (2006.01)

(52) U.S. Cl.
CPC ..... *E21B 43/08* (2013.01); *E21B 34/08* (2013.01)

(58) Field of Classification Search
CPC ..... E21B 43/08; E21B 43/082; E21B 43/084; E21B 43/086; E21B 43/088
USPC ..... 166/236, 234, 227
See application file for complete search history.

(56) References Cited

U.S. PATENT DOCUMENTS

| | | | |
|---|---|---|---|
| 1,473,644 | A | 11/1923 | Rodrigo |
| 1,594,788 | A | 1/1925 | McLaughlin et al. |
| 1,620,412 | A | 3/1927 | Tweeddale |
| 2,681,111 | A | 6/1954 | Thompson |
| 3,173,488 | A | 3/1965 | Rensvold |

(Continued)

FOREIGN PATENT DOCUMENTS

WO WO 2013/055451 4/2013

OTHER PUBLICATIONS

Yeh, C.S. et al., "A Self-Mitigating Sand Control Screen", SPE 121844, SPE European Formation Damage Conference, May 27-29, 2009, 6 pages, Scheveningen, The Netherlands.

(Continued)

*Primary Examiner* — Kenneth L Thompson
(74) *Attorney, Agent, or Firm* — ExxonMobil Upstream Research Company-Law Department

(57) ABSTRACT

A completion joint 100 has two sand control jackets 120A-B connected on each end of an intermediately-mounted inflow control device 130. Both jackets 120A-B communicate with a housing chamber 155 through dedicated open end-rings 140A-B. The basepipe's flow openings 118 are isolated from this housing chamber 155 by a sleeve 160 fitted with flow ports 170. The housing 150 is removable to allow access to the flow ports 170 for pinning to configure the ports 170 open or closed for a given implementation.

20 Claims, 6 Drawing Sheets

(56) References Cited

U.S. PATENT DOCUMENTS 3,357,564 A 12/1967 Medford, Jr. et al.
3,556,219 A 1/1971 Meldau
4,064,938 A 12/1977 Fast
4,428,428 A 1/1984 Smyrl et al.
4,657,079 A 4/1987 Nagaoka
4,771,829 A 9/1988 Sparlin
4,818,403 A 4/1989 Nagaoka
4,945,991 A 8/1990 Jones
4,977,958 A 12/1990 Miller
5,004,049 A 4/1991 Arterbury
5,069,279 A 12/1991 Nagaoka
5,076,359 A 12/1991 Yeh
5,082,052 A 1/1992 Jones et al.
5,083,614 A 1/1992 Branch
5,113,935 A 5/1992 Jones et al.
5,115,864 A 5/1992 Gaidry et al.
5,161,613 A 11/1992 Jones
5,161,618 A 11/1992 Jones et al.
5,165,476 A 11/1992 Jones
5,209,296 A 5/1993 Donlon
5,222,556 A 6/1993 Donlon
5,246,158 A 9/1993 Nagaoka et al.
5,307,984 A 5/1994 Nagaoka et al.
5,311,942 A 5/1994 Nagaoka
5,318,119 A 6/1994 Lowry et al.
5,332,045 A 7/1994 Ross et al.
5,333,688 A 8/1994 Jones et al.
5,333,689 A 8/1994 Jones et al.
5,341,880 A 8/1994 Thorstensen et al.
5,355,949 A 10/1994 Sparlin et al.
5,390,966 A 2/1995 Cox et al.
5,392,850 A 2/1995 Cornette et al.
5,396,954 A 3/1995 Brooks
5,404,945 A 4/1995 Head et al.
5,415,202 A 5/1995 Shiffler et al.
5,417,284 A 5/1995 Jones
5,419,394 A 5/1995 Jones
5,435,391 A 7/1995 Jones
5,450,898 A 9/1995 Sparlin et al.
5,476,143 A 12/1995 Sparlin et al.
5,505,260 A 4/1996 Anderson et al.
5,515,915 A 5/1996 Jones et al.
5,560,427 A 10/1996 Jones
5,588,487 A 12/1996 Bryant
5,642,781 A 7/1997 Richard
5,664,628 A 9/1997 Koehler et al.
5,690,175 A 11/1997 Jones
5,787,980 A 8/1998 Sparlin et al.
5,803,179 A * 9/1998 Echols ..... E21B 43/084 166/242.1
5,842,516 A 12/1998 Jones
5,848,645 A 12/1998 Jones
5,868,200 A 2/1999 Bryant et al.
5,881,809 A * 3/1999 Gillespie ..... B01D 29/15 166/233
5,890,533 A 4/1999 Jones
5,896,928 A 4/1999 Coon
5,909,774 A 6/1999 Griffith et al.
5,934,376 A 8/1999 Nguyen et al.
6,003,600 A 12/1999 Nguyen et al.
6,112,817 A 9/2000 Voll et al.
6,125,932 A 10/2000 Hamid et al.
6,220,345 B1 4/2001 Jones et al.
6,223,906 B1 5/2001 Williams
6,227,303 B1 5/2001 Jones
6,230,803 B1 5/2001 Morton et al.
6,298,916 B1 10/2001 Tibbles et al.
6,302,207 B1 10/2001 Nguyen et al.
6,405,800 B1 6/2002 Walker et al.
6,409,219 B1 6/2002 Broome et al.
6,427,775 B1 8/2002 Dusterhoft et al.
6,446,722 B2 9/2002 Nguyen et al.
6,464,261 B1 10/2002 Dybevik et al.
6,481,494 B1 11/2002 Dusterhoft et al.
6,494,265 B2 12/2002 Wilson et al.
6,513,599 B1 2/2003 Bixenman et al.
6,516,881 B2 2/2003 Hailey, Jr.
6,540,022 B2 4/2003 Dusterhoft et al.
6,557,634 B2 5/2003 Hailey, Jr. et al.
6,575,245 B2 6/2003 Hurst et al.
6,575,251 B2 6/2003 Watson et al.
6,581,689 B2 6/2003 Hailey, Jr.
6,588,506 B2 7/2003 Jones
6,601,646 B2 8/2003 Streich et al.
6,619,397 B2 9/2003 Coon et al.
6,622,794 B2 9/2003 Zisk, Jr.
6,644,406 B1 11/2003 Jones
6,666,274 B2 12/2003 Hughes
6,675,245 B1 1/2004 Schmidt
6,695,067 B2 2/2004 Johnson et al.
6,698,518 B2 3/2004 Royer et al.
6,715,544 B2 4/2004 Gillespie et al.
6,749,023 B2 6/2004 Nguyen et al.
6,749,024 B2 6/2004 Bixenman
6,752,206 B2 6/2004 Watson et al.
6,752,207 B2 6/2004 Donos
6,755,245 B2 6/2004 Nguyen et al.
6,789,623 B2 9/2004 Hill, Jr. et al.
6,814,139 B2 11/2004 Hejl et al.
6,817,410 B2 11/2004 Wetzel et al.
6,830,104 B2 12/2004 Nguyen et al.
6,848,510 B2 2/2005 Bixenman et al.
6,857,475 B2 2/2005 Johnson
6,886,634 B2 5/2005 Richards
6,923,262 B2 8/2005 Broome et al.
6,935,432 B2 8/2005 Nguyen
6,983,796 B2 1/2006 Bayne et al.
6,986,390 B2 1/2006 Doanne et al.
6,997,263 B2 2/2006 Campbell et al.
7,048,061 B2 5/2006 Bode et al.
7,055,598 B2 6/2006 Ross et al.
7,096,945 B2 8/2006 Richards et al.
7,100,691 B2 9/2006 Nguyen et al.
7,104,324 B2 9/2006 Wetzel et al.
7,152,677 B2 12/2006 Parlar et al.
7,207,383 B2 4/2007 Hurst et al.
7,234,518 B2 6/2007 Smith
7,243,724 B2 7/2007 McGregor et al.
7,252,142 B2 8/2007 Brezinski et al.
7,264,061 B2 9/2007 Dybevik et al.
7,370,700 B2 5/2008 Hurst et al.
7,377,320 B2 5/2008 Michel
7,383,886 B2 6/2008 Dybevik et al.
7,431,058 B2 10/2008 Holting
7,464,752 B2 12/2008 Dale et al.
7,475,725 B2 1/2009 Yeh et al.
7,581,586 B2 * 9/2009 Russell ..... E21B 43/082 166/227
7,625,846 B2 12/2009 Cooke, Jr.
7,661,476 B2 2/2010 Yeh et al.
7,735,559 B2 6/2010 Malone
7,814,973 B2 10/2010 Dusterhoft et al.
7,845,407 B2 12/2010 Bunnell et al.
7,861,787 B2 * 1/2011 Russell ..... E21B 43/082 166/169
7,870,898 B2 1/2011 Yeh et al.
7,891,420 B2 2/2011 Dale et al.
7,984,760 B2 7/2011 Haeberle et al.
7,987,909 B2 * 8/2011 Pineda ..... E21B 34/14 166/235
8,127,831 B2 3/2012 Haeberle et al.
8,225,863 B2 * 7/2012 Hammer ..... E21B 34/14 166/235
8,245,778 B2 8/2012 Yeh et al.
8,522,867 B2 9/2013 Yeh et al.
9,027,642 B2 * 5/2015 Sladic ..... E21B 41/0078 166/263
2003/0159825 A1 8/2003 Hurst et al.
2003/0173075 A1 9/2003 Morvant et al.
2003/0189010 A1 10/2003 Wilhelm
2004/0007829 A1 1/2004 Ross
2004/0140089 A1 7/2004 Gunneroed
2005/0039917 A1 2/2005 Hailey, Jr.
2005/0045329 A1 3/2005 Wetzel et al.

(56) References Cited

U.S. PATENT DOCUMENTS

| | | | | |
|---|---|---|---|---|
| 2005/0067170 | A1 | 3/2005 | Richard | |
| 2005/0082060 | A1 | 4/2005 | Ward et al. | |
| 2005/0178562 | A1 | 8/2005 | Livingstone | |
| 2007/0114020 | A1 | 5/2007 | Brekke | |
| 2008/0006402 | A1 | 1/2008 | Russell | |
| 2008/0041577 | A1 | 2/2008 | Baaijens et al. | |
| 2008/0217002 | A1 | 9/2008 | Simonds et al. | |
| 2008/0283238 | A1* | 11/2008 | Richards | E21B 23/04 166/228 |
| 2009/0000787 | A1* | 1/2009 | Hill | E21B 43/08 166/344 |
| 2009/0095471 | A1 | 4/2009 | Guignard et al. | |
| 2009/0151925 | A1* | 6/2009 | Richards | E21B 34/06 166/53 |
| 2009/0159279 | A1 | 6/2009 | Assal | |
| 2009/0159298 | A1 | 6/2009 | Assal | |
| 2009/0277650 | A1 | 11/2009 | Casciaro et al. | |
| 2010/0084133 | A1 | 4/2010 | Weirich et al. | |
| 2010/0096120 | A1 | 4/2010 | Ayasse | |
| 2010/0175894 | A1 | 7/2010 | Debard et al. | |
| 2012/0061093 | A1 | 3/2012 | Garcia et al. | |
| 2013/0062066 | A1 | 3/2013 | Broussard et al. | |
| 2013/0092394 | A1* | 4/2013 | Holderman | E21B 43/108 166/373 |
| 2014/0262324 | A1* | 9/2014 | Greci | E21B 43/08 166/374 |

OTHER PUBLICATIONS

Yeh, C.S. et al., "Advancing Self-Mitigating Sand Control Screen", IPTC 13614, International Petroleum Technology Conference, Dec. 7-9, 2009, 7 pages, Doha Qatar.

Yeh, C.S. et al., "Enhancing Sand Screen Reliability: An Innovative, Adaptive Approach", SPE 134492, SPE Annual Technical Conference, Sep. 19-22, 2010, 9 pages, Florence, Italy.

Yeh, C.S. et al., "Unlocking the Limits of Sand Screen Reliability with an Innovative and Self-Adapting Technology", IPTC 14623, 2011, 10 pages.

* cited by examiner

APPARATUS AND METHODS FOR WELL CONTROL

CROSS REFERENCE TO RELATED APPLICATIONS

This application claims the benefit of U.S. Provisional No. 61/798,717, filed Mar. 15, 2013, and is incorporated by reference herein in its entirety.

BACKGROUND OF THE DISCLOSURE

In unconsolidated formations, horizontal and deviated wells are routinely completed with completion systems having integrated sand screens. To control the flow-rate of produced fluids (such as to reduce tubular erosion due to abrasive sand entrained within the produced fluid) the sand screens may use inflow control devices (ICD) to slow fluid rate through the sand screening elements. One ICD example is disclosed in U.S. Pat. No. 5,435,393 to Brekke et al. Other examples of inflow control devices are also available, such as the FloReg™ ICD available from Weatherford International, the Equalizer® ICD available from Baker Hughes, ResFlow™ ICD available from Schlumberger, and the Equi-Flow® ICD available from Halliburton. (EQUALIZER is a registered trademark of Baker Hughes Incorporated, and EQUIFLOW is a registered trademark of Halliburton Energy Services, Inc.)

For example, a completion system 10 in FIG. 1 has completion screen joints 50 deployed on a completion string 14 in a borehole 12. Typically, these screen joints 50 are used for horizontal and deviated boreholes passing through a loosely or unconsolidated formation as noted above, and packers 16 or other isolation elements may be used between the various joints 50. During production, fluid produced from the borehole 12 passes through the screen joints 50 and up the completion production string 14 to the surface facility rig 18. The screen joints 50 keep out particulate formation fines, stimulation sand, and other potentially damaging particulates migrating in the produced fluid. In this way, the screen joints 50 can mitigate erosional damage to components, mud caking in the completion system 10, and other problems associated with fines, particulate, and the like present in the produced fluid.

Turning to FIGS. 2A-2C, a prior art completion screen joint 50 is illustrated in side view, partial side cross-sectional view, and in a more detailed cut-away side view. The screen joint 50 may include a basepipe 52 with a sand control screen or jacket 60 and an inflow control device 70 disposed thereon. The basepipe 52 defines a through-bore 55 and has a coupling crossover 56 at one end for connecting to another screen joint, spacer-joint, or the like. The other end 54 can connect to a crossover (not illustrated) of another joint on the completion string. Inside the through-bore 55, the basepipe 52 defines pipe ports 58 where the inflow control device 70 (ICD) is disposed.

The joint 50 is deployed on a production string (14: FIG. 1) with the screen 60 typically mounted so that the screen elements are upstream of the inflow control device 70, but the screen may be positioned structurally above, even with, or below the ICD. Here, the ICD 70 illustrated is somewhat similar to the FloReg™ ICD available from Weatherford International. As illustrated in FIG. 2C, ICD 70 has an outer sleeve 72 disposed about the basepipe 52 at the location of the pipe ports 58. A first end-ring 74 seals to the basepipe 52 with a seal element 75, and a second end-ring 76 engages with the end of the screen 60. Overall, the sleeve 72 defines an annular or inner space 86 around the basepipe 52 communicating the pipe ports 58 with the sand control jacket 60. The second end-ring 76 has flow ports 80, which separates the sleeve's inner space 86 from the screen 60.

For its part, the sand control jacket 60 is disposed around the outside of the basepipe 52. As illustrated, the sand control jacket 60 can be a wire wrapped screen having rods or ribs 64 arranged longitudinally along the basepipe 52 with windings of wire 62 wrapped thereabout to form various slots. Fluid can pass from the surrounding borehole annulus to the annular gap between the sand control jacket 60 and the basepipe 52.

Internally, the inflow control device 70 has nozzles 82 disposed in the flow ports 80. The nozzles 82 restrict flow of screened fluid (i.e., inflow) from the screen jacket 60 to the device's inner space 86 to produce a pressure drop. For example, the inflow control device 70 may have ten nozzles 82, although they all may not be open. Operators may set a number of these nozzles 82 open at the surface to configure the device 70 for use downhole in a given implementation. Depending on the number of open nozzles 82, the device 70 can thereby produce a configurable pressure drop along the screen jacket 60.

To configure the device 70, pins 84 can be selectively placed in the passages of the nozzles 82 to close them off. The pins 84 are typically hammered in place with a tight interference fit and are removed by gripping the pin with a vice grip and hammering on the vice grip. These operations need to be performed off rig beforehand so that valuable rig time is not used up making such adjustments.

When the joints 50 are used in a horizontal or deviated borehole as illustrated in FIG. 1, the inflow control devices 70 help evenly distribute the flow along the completion string 14 and prevent coning of water in the heel section. Overall, the devices 70 choke production to create an even-flowing pressure-drop profile along the length of the horizontal or deviated section of the borehole 12.

Although the inflow control device 70 of the prior art and its arrangement on a completion screen joint 50 is often effective, the prior art completion screen joint 50 such as illustrated in FIGS. 2A-2C has an inflow control device 70 disposed near an end of a sand control jacket 60. Fluid flow through the sand control jacket 60 comes in from only one direction and also tends to be sourced from the sand screen into the flow annulus 64 from the vicinity of greatest pressure drop across the screen, that being in the vicinity of the sand screen nearest the inflow control device 70. More distant portions of the sand screen tend to contribute slower and lesser fluid flow rates to the annulus 64 and ICD 70. Consequently, a majority of the screen jacket 60 may be underutilized.

The more concentrated inflow through the jacket 60 near the device 70 also produces formation fluids less efficiently and can lead to issues with plugging and clogging. This unbalanced flow rate distribution can lead to screen erosion, tool plugging, and other associated problems. However, once a screen jacket 62 becomes compromised with erosional holes, the entirety of the screen becomes virtually useless for its intended purpose. Plugging can also be an issue at any point during operations and may even be problematic when the joint 50 is initially installed in the borehole. For example, the joint 50 may be initially lowered into an unconditioned mud, which can eventually plug the screen 60 and cause well performance and productivity to significantly decline.

Additionally, for vertical, horizontal, and deviated boreholes in an unconsolidated formation, it is beneficial to place stimulation fluids effectively to overcome any near borehole damage and screen plugging that may have developed. Accordingly, a cleanup operation may need to be performed by bullheading a treatment fluid into the well. In bullheading, operators fill a portion of the borehole with treatment fluid (such as an acid system) by pumping the fluid down the tubing string 14 and using fluid pressure to cause the stimulation fluid to flow out of the inflow control device 70 and screen 60, and into the surrounding borehole. Unfortunately, the treatment fluid may be disproportionately forced into the area of the formation near the inflow control device 70 and not into other regions of need. As a result, the concentrated flow and "overstimulation" can cause fluid loss and can over-treat certain areas compared to others. More even and controlled stimulation fluid placement is needed.

The subject matter of the present disclosure is, therefore directed to overcoming, or at least reducing the effects of, one or more of the problems set forth above.

SUMMARY

A sand control apparatus for a wellbore completion string or system may include a basepipe with a bore for conveying the production fluid to the surface. To prevent sand and other particulate fines from passing through openings in the basepipe to the bore, first and second screens may be disposed on the basepipe for screening fluid produced from the surrounding borehole. Disposed on the basepipe between these first and second screens, an intermediately-mounted inflow control device is in fluid communication with screened fluid from both of the first and second screens. Screened fluid from both (or selectively either) of the two (first and second) screens passes to the ICD, from which the fluid can eventually pass to the basepipe's bore through the ICD opening.

In some embodiments, to control the flow of the fluid and create a desired pressure drop a flow device disposed with the ICD may control fluid communication of the screened fluid into the openings in the basepipe. In one implementation, the flow device includes one or more flow ports having nozzles or orifices. A number of the flow ports and nozzles may be provided to control fluid communication for a particular implementation and the nozzles can be configured to allow flow, restrict flow, or prevent flow by use of an adjustable apparatus or sizeable apparatus, such as an adjustable pin for example.

To configure the number of nozzles that will permit flow, a housing of the inflow control device may be removable from the basepipe so operators can gain access to the nozzles. For example, the housing can use a housing sleeve that can slide onto two, separated end-rings to enclose the housing chamber. One end of this housing sleeve can abut against a shoulder on one end-ring, while the housing sleeve's other end can be affixed to the other end-ring using lock wires or other fasteners. When the housing sleeve is removed, the nozzles can be configured either open or closed to produce a configurable pressure drop when deployed downhole.

In one implementation, the flow device may define a flow device chamber or annular region with respect to the basepipe. The device chamber is separate from a housing chamber of the inflow control device and fluidly communicates with the basepipe opening. One or more flow ports having nozzles in turn communicate the housing chamber with the device chamber. In this implementation, the flow device has a sleeve disposed in the inflow control device's housing next to the openings in the basepipe. Ends of the sleeve are attached to the basepipe and enclose the device chamber. The at least one flow port is defined in one of the ends of the sleeve and has the nozzle, which may preferably be composed of an erosion resistant material, such as tungsten carbide. Additionally, the at least one flow port may preferably axially align parallel to the axis of the basepipe.

During operation, screened fluid from the screens flows through passages in the end-rings of the inflow control device's housing that abut the inside ends of the screens. Once in the housing's chamber, the screened fluid then passes through the open nozzles in the flow ports, which then restrict fluid communication from the housing chamber to the device chamber and produce a configured pressure drop. Once in the device chamber, the fluid can communicate through the basepipe's openings to be conveyed uphole via the pipe's bore.

The foregoing summary is not intended to summarize each potential embodiment or every aspect of the present disclosure.

DETAILED DESCRIPTION OF THE DISCLOSURE

Figure 1:
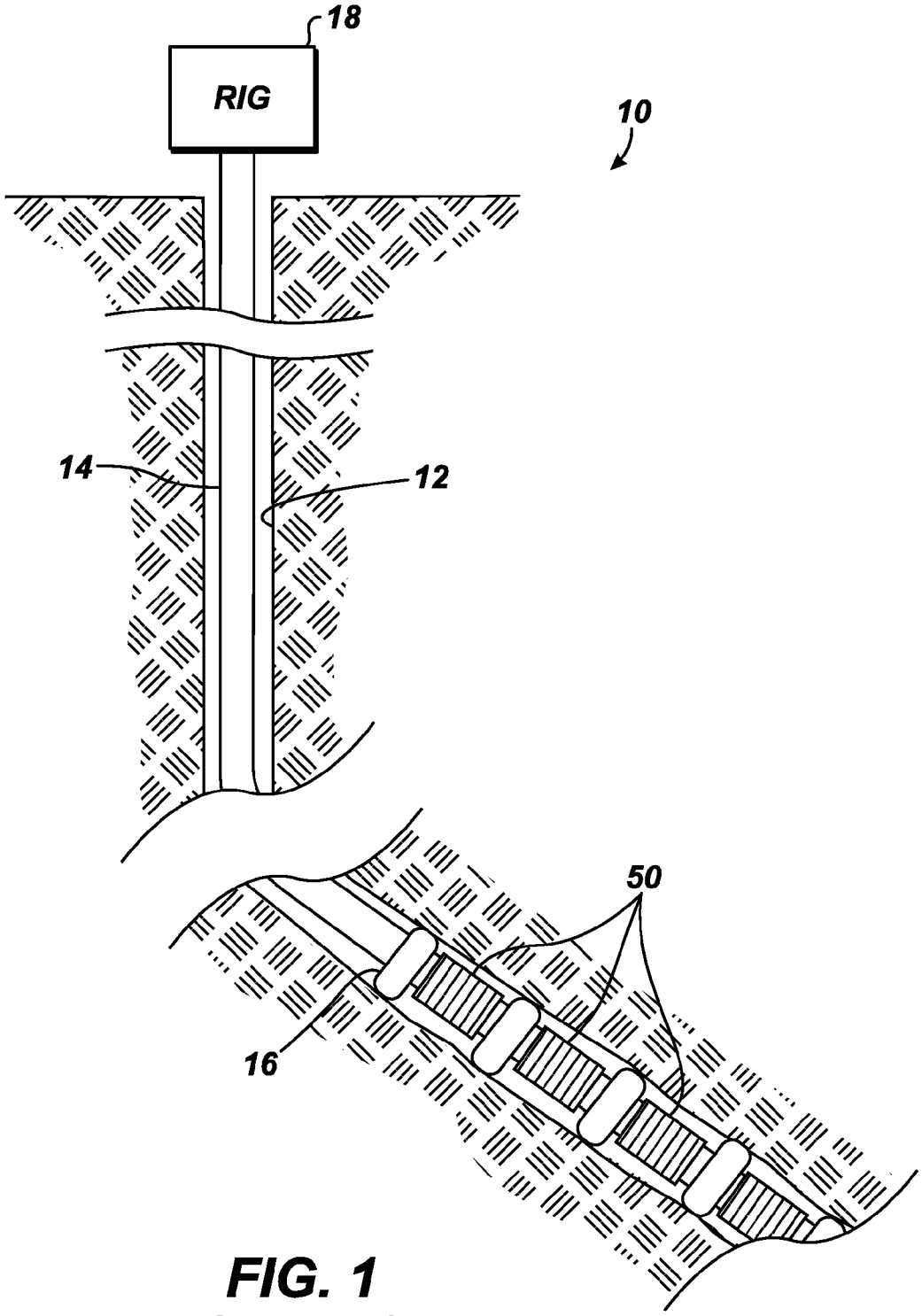
FIG. 1 (Prior Art)
FIG. 1 illustrates a prior art completion system having completion screen joints deployed in a borehole.

An exemplary well completion sand screen joint 100 according to some embodiments of the present disclosure are illustrated in FIGS. 3A-3E. Such embodiments and related embodiments not directly illustrated can overcome many, if not all of the above-discussed limitations of the prior art completion screen joints and ICDs. The exemplary joint 100 is depicted in a side view in FIG. 3A, a partial cross-sectional view in FIG. 3B, a more detailed view in FIG. 3C, a partial perspective view in FIG. 3D, and an end-sectional view in FIG. 3E. This completion screen joint 100 can be used in a completion system, such as described above with reference to FIG. 1, so that the details are not repeated here. The "joint" may actually comprise multiple sections, segments, tools, etc., that are connected together to comprise a completion tool string and may comprise multiple sets of interconnected, isolated, or segmented sets of ICD's, sand screens, packers, blank pipes, etc. The simplified drawings presented herein are merely exemplary and the use of singular terms such as joint or screen or tool are merely used to keep the discussion simple and understandable.

For this completion screen joint 100, an inflow control device 130 is intermediately mounted (positioned) on a basepipe 110 between two sand control jackets or screen sections 120A-B, with one of the two screens disposed toward each end of the ICD 130. The term "intermediate" as used herein merely means that the ICD 130 is axially positioned along the tool string 100 such that it receives fluid flow in a first direction from a first sand screen and in a second direction from a second sand screen. In most embodiments, the ICD 130 will receive flow from both the first and second sand screens substantially simultaneously. However, some embodiments may provide additional flow control components (not illustrated herein) that may provide for selectively closing off or controlling fluid flow from one or both of the first or second sand screens to the ICD 130.

The basepipe 110 generally defines a through-bore 115 for conveying produced fluid to the surface and comprises flow openings 118 for conducting produced fluid from outside the basepipe 110 into the through-bore 115. To connect the joint 100 to other components of a completion system, the basepipe 110 may include a coupling crossover 116 at one end, while the other end 114 may connect to a crossover (not illustrated) of another basepipe.

Figure 3A:
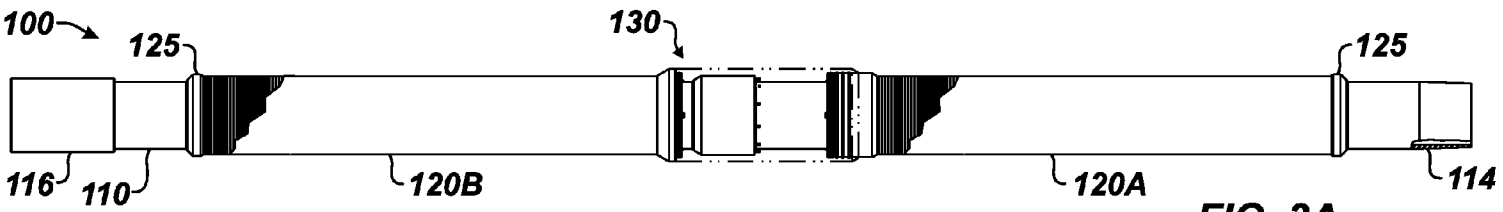
FIG. 3A illustrates an exemplary completion screen joint according to the present disclosure.
Figure 3B:
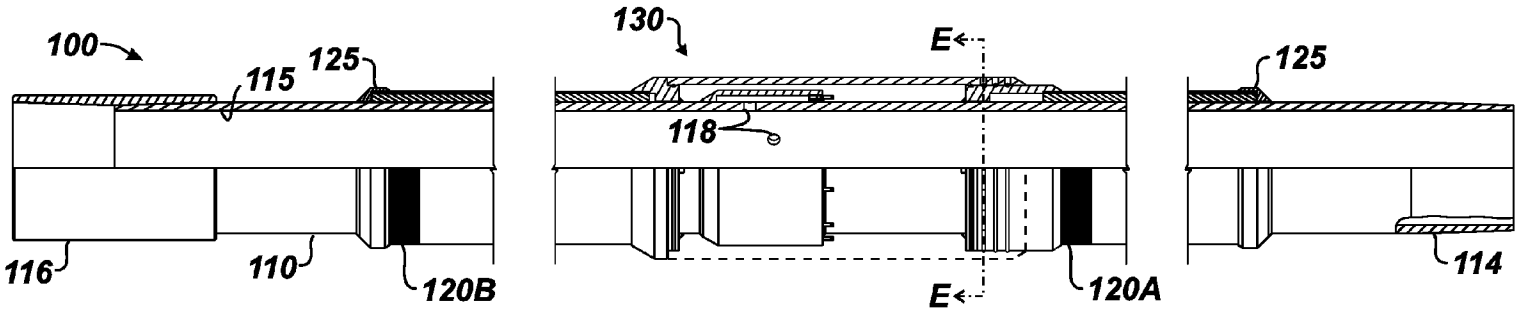
FIG. 3B illustrates an exemplary completion screen joint in partial cross-section.
Figure 3C:
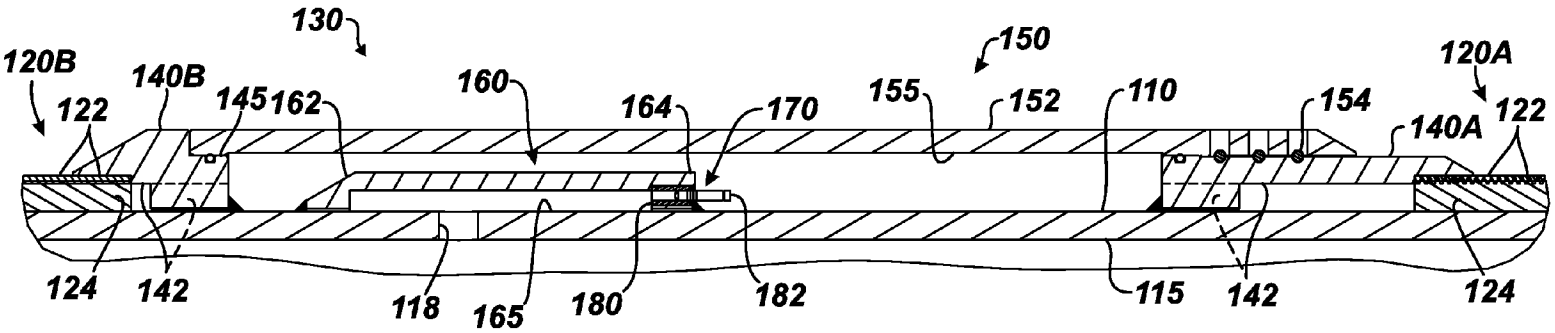
FIG. 3C illustrates a detail of the disclosed completion screen joint.
Figure 3D:
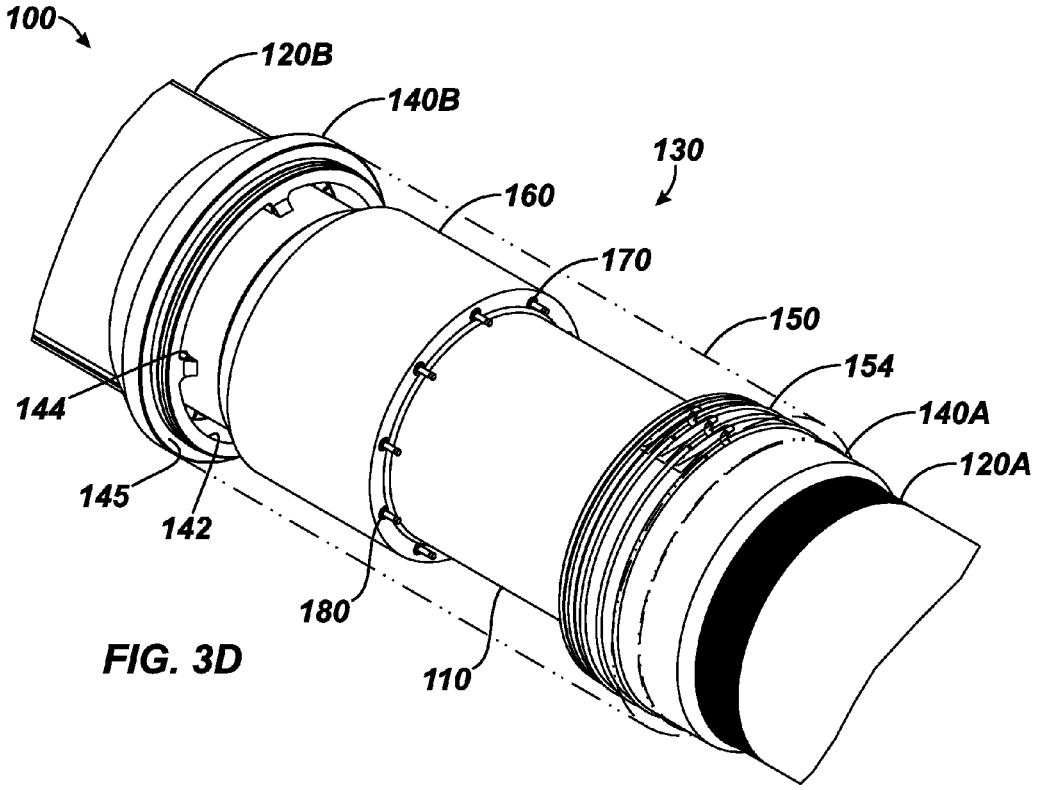
FIG. 3D illustrates a perspective view of an exemplary portion of the disclosed completion screen joint.

For their part, the sand control jackets 120A-B disposed around the outside of the basepipe 110 use any of the various types of screen assemblies known and used in the art. The two screen jackets 120A-B may be the same or different from one another so that the flow characteristics and the screening capabilities of the joint 100 can be selectively configured for a particular implementation. In general, the screen jackets 120A-B can comprise one or more layers, including wire wrappings, porous metal fiber, sintered laminate, pre-packed media, etc. The segments may also be equally or non-equally distally spaced from the ICD 130. As illustrated in FIGS. 3A-3C, for example, the jackets 120A-B can be wire-wrapped screens having rods or ribs 124 arranged longitudinally along the basepipe 110 with windings of wire 122 wrapped thereabout and provided gauged openings between adjacent wire wraps to enable fluid entry while excluding passage of formation particulates. The wire 122 may forms various slots for screening produced fluid and the longitudinal ribs or supports 124 create gaps or channels that operate as an underlying annulus, passage, or drainage layer exterior to the basepipe, enabling filtered fluid to flow toward an ICD 130.

Figure 2A:
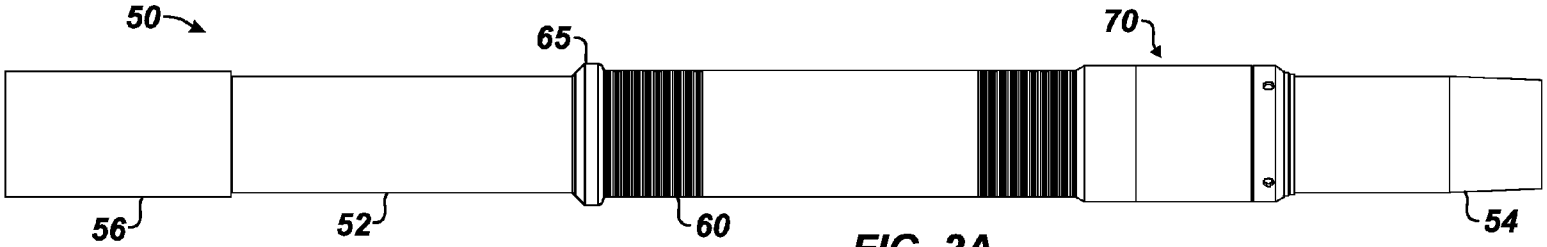
FIG. 2A (Prior Art)
FIG. 2A illustrates a completion screen joint according to the prior art.
Figure 2B:
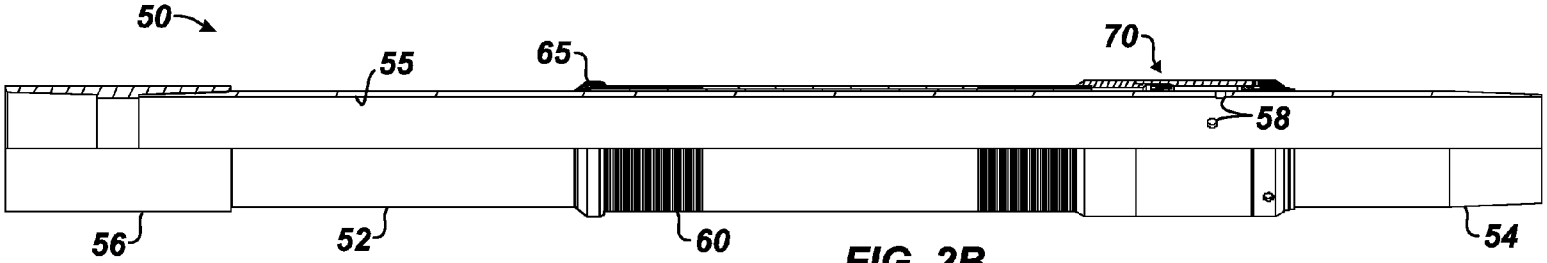
FIG. 2B (Prior Art)
FIG. 2B illustrates the prior art completion screen joint in partial cross-section.
Figure 2C:
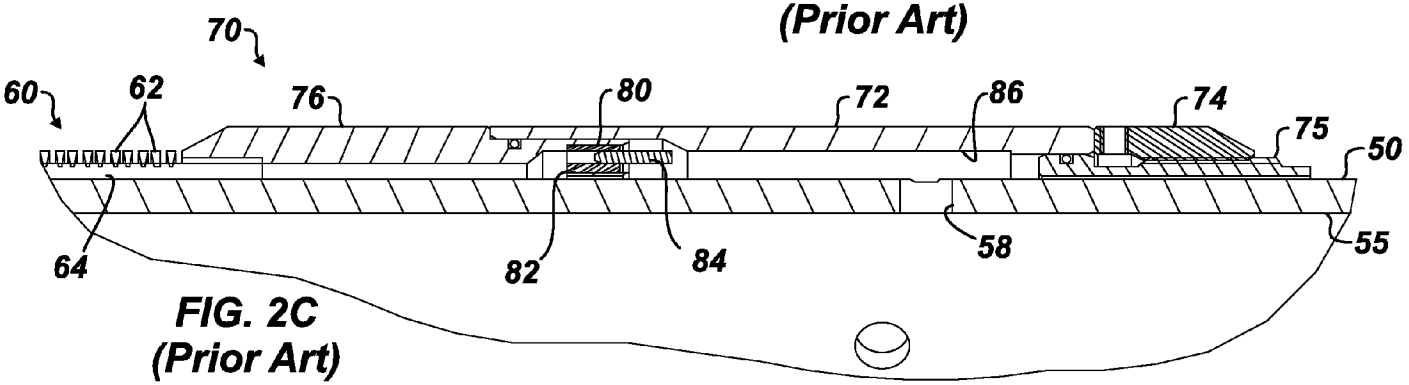
FIG. 2C (Prior Art)
FIG. 2C illustrates a detail on an inflow control device for the prior art completion screen joint.

Other types of screen assemblies may be used for the jackets 120A-B, including metal mesh screens, pre-packed screens, protective shell screens, expandable sand screens, or screens of other construction. Overall, the sand control jackets 120A-B can offer the same length or surface area for screening the produced fluid in the borehole as is provided by the single screen of the prior art joint 50 detailed in FIGS. 2A-2C. Otherwise, the screen joints 120A-B may have less or more length or surface area for screening as required by the implementation.

During production, fluid can pass from the formation or wellbore annulus into the sand control jackets 120A-B and pass along the annular gaps or channels between the sand control jacket 120A-B and the basepipe 110. Outside edges of the screen jackets 120A-B have closed end-rings 125, preventing fluid from bypassing the screens. In some embodiments, the tool assembly may include one ICD 130 and companion sets of screen jackets 120A-B, such as illustrated in FIG. 3A-C. In other embodiments may include combinations of sand jackets and multiple ICD's such as for example, two sand jackets 120A-B and intermediate sand jacket 120C (not illustrated) positioned between the two IDC's (two not illustrated), all positioned between a pair of end-rings 125, such that flow from screen C may flow to either or both of the two IDC's. Referring again to the simple embodiment illustrated in FIG. 3A-C, the screened fluid in the annular gaps or channels of the two jackets 120A-B and the basepipe 110 passes to the passages 142 of open end-rings 140A-B to enter the inflow control device 130 disposed between the jackets 120A-B.

The inflow control device 130 is disposed on the basepipe 110 at the location of the flow openings 118 and between the two screen jackets 120A-B. As best illustrated in exemplary FIG. 3C, the inflow control device 130 may have open end-rings 140A-B (noted above) and an outer housing 150 disposed between the end-rings 140A-B. The first end-ring 140A abuts the inside edge of one screen jacket 120A, while the second end-ring 140B abuts the inside edge of the other screen jacket 120B. The housing 150 has a cylindrical sleeve 152 disposed about the basepipe 110 and supported on end-rings 140A-B to enclose a housing chamber 155.

Figure 3E:
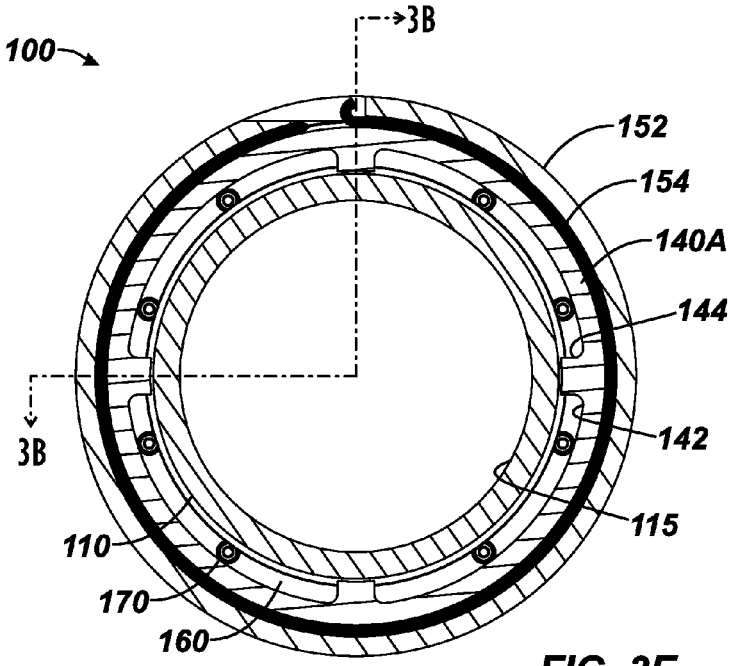
FIG. 3E illustrates an exemplary end section of the disclosed completion screen joint taken along line E-E of FIG. 3B.

In the illustrated example embodiment, both end-rings 140A-B have internal channels, slots, or passages 142 that can fit partially over the inside edges of the jackets 120A-B as illustrated in FIG. 3C. During use, the passages 142 allow fluid screened by the jackets 120A-B to communicate through the open or flow-permitting end-rings 140A-B to the housing chamber 155. As also illustrated in the exposed perspective of FIG. 3D, walls or dividers 144 between the passages 142 support the open end-rings 140A-B to the housing chamber 155 exterior to the basepipe 110. In other embodiments, the flow-path may comprise conduits bored through the end-ring body 140A-B, parallel to the tool central axis. FIG. 3E illustrates an end-section of the joint 100 and reveals the flow passages 142 and dividers 144 of the end-ring 140B in more detail. It will be appreciated that the open end-rings 140A-B can be configured in other ways with openings to allow fluid flow there-through.

A sand control apparatus for a wellbore completion string or system may include a basepipe with a bore 115 for conveying the production fluid to the surface. To prevent sand and other particulate fines from passing through openings in the basepipe to the bore, first and second screens may be disposed on the basepipe for screening fluid produced from the surrounding borehole. Disposed on the basepipe between these first and second screens, an intermediately-mounted inflow control device is in fluid communication with screened fluid from both of the first and second screens. This arrangement enables one ICD to regulate fluid from multiple screens or multiple screen tools. Alternatively, if one ICD becomes plugged, fails closed, or is not regulating flow properly, the produced fluid from one of the screen tools (of the first and second screens) can bypass the failed ICD and proceed into the annular area of the other sand screen tool (the other of the first or second screens) and proceed on to another ICD for properly regulated production rate. Thereby, no production is lost due to lost conductivity or failed production equipment. Screened fluid from both (or selectively either) of the two (first and second) screens passes to the ICD, from which the fluid can eventually pass to the basepipe's bore through the ICD opening.

As noted above, the housing's cylindrical sleeve 152 forms the housing chamber 155 (e.g., an annular space) around the basepipe 110, which communicates the sand control jackets 120A-B with the pipe's flow openings 118. As best illustrated in FIG. 3C, the sleeve 152 of the housing 150 can fit over the first end-ring 140A to slide in position to form the housing chamber 155. The end of the housing's sleeve 152 then abuts a shoulder 145 on the second end-ring 140B and seals therewith with an O-ring seal. The opposing end of the housing's sleeve 152, however, rests on the first end-ring 140A, sealing against an O-ring seal, and secured thereto by any suitable securing means. For example, lock wires 154 may be fitted around the first end-ring 140A and fix the sleeve 152 in place, although it will be appreciated that a lock ring arrangement (e.g., 74/75 as in FIG. 2C) or other type of fastener could be used to hold the sleeve 152 in place. Constructed in this manner, the housing 150 is removable from the inflow control device 130 so internal components (detailed below) of the device 130 can be configured before deployment and can be serviced or cleaned between operations.

Inside the housing chamber 155 and accessible when the sleeve 152 is removed, the inflow control device 130 has an internal sleeve 160 disposed over the location of the flow openings 118 in the basepipe 110. First 162 and second 164 ends of the flow control sleeve or pocket 160 are closed and attached to the basepipe 110 to enclose an interior chamber 165, which is in communication with the openings 118. Flow control sleeve or pocket 160 functions generally to conduct fluid from the ICD into a port 118. In some embodiments the flow control sleeve may be circumferentially disposed about the exterior surface of the basepipe 110, such as illustrated in FIG. 3 A-E. In other embodiments, the sleeve 160 may only partially circumferentially encompass the basepipe 100, such as forming more of a pocket for controlling flow from the ICD into the port 118. In the illustrated embodiment, the sleeve is circumferentially encompassing of the basepipe 115 and the second end 164 supports one or more flow control devices 170 that may restrict or regulate flow of screened fluid from the housing chamber 155 to the interior chamber 165 of the sleeve 160 and then through the port 118 and into the bore 115.

Each of the flow control devices 170 may include a flow port or aperture and may include a nozzle or insert 180 positioned therein for restricting or regulating the flow rate and producing a pressure drop across the device 170. Preferably, these nozzles 180 are composed of an erosion-resistant material, such as tungsten carbide, to prevent flow-induced erosion.

To configure the device 130 to control flow, only a set number of open nozzles 180 may be provided, or the nozzles 180 may all be open and selectively closed, such as by differential pressure. For example, pins 182 can be disposed in the nozzles 180 to close off or regulate flow through the nozzles 180. The pins 182 can likewise be removed to allow flow through the nozzles 180. Other variations, such as nozzles 180 with different internal passages, blank inserts disposed in the flow ports, etc., can be used to configure the flow control and restriction provided by the inflow control device 130 to meet the needs of an implementation.

In general, the sleeve 160 can have several (e.g., ten) flow devices 170, although they all may not be open during a given deployment. At the surface, operators may configure the number of flow devices 170 having open nozzles 180 (e.g., without pins 182) so the inflow control device 130 can produce a particular pressure drop needed in a given implementation. In this way, operators can configure flow through the device 130 to the basepipe's openings 118 through any of one to ten open flow devices 170. In turn, the device 130 can produce a configurable pressure drop along the screen jackets 120A-B. For example, if one open nozzle 180 is provided, the inflow control device 130 allows for less inflow and can produce an increasing pressure drop across the device 130 with an increasing flow rate. The more open nozzles 180 provided means that more inflow is possible, but less markedly will the device 130 exhibit an increase in pressure drop relative to an increase in flow rate.

Once configured, the inflow control device 130 (along with the sand screens) during operation downhole produces a pressure drop between the wellbore annulus and the string's interior bore 115. The pressure drop produced depends on fluid density and fluid viscosity so the device 130 may inhibit water production and encourage hydrocarbon production by backing up water from being produced. In particular, the open nozzles 180 of the flow devices 170 can be relatively insensitive to viscosity differences in fluid flow there-through and are instead sensitive to the density of the fluid. When fluid is produced from the borehole, the produced fluid flows through the open nozzles 180, which create a pressure drop that keeps the higher density of water backed up. This can be helpful if a water breakthrough event does occur during production.

The flow ports (e.g., nozzles 180) of the flow devices 170 are also preferably defined axially along the basepipe 110 so fluid flow passes parallel to the basepipe's axis, which evenly distributes flow along the production string. In the end, the inflow control device 130 can adjust an imbalance of the inflow caused by fluid-frictional losses in homogeneous reservoirs or caused by permeability variations in heterogeneous reservoirs.

In summary, the intermediately-mounted inflow control device 130 on the completion screen joint 100 can control the flow of produced fluid beyond what is conventionally available. During operation, fluid flow from the borehole annulus directs through the screen jackets 120A-B, and screened fluid passes in both directions along the basepipe 110 in the annular gaps to the centrally-mounted device 130. Reaching the ends of the jackets 120A-B, the flow of the screened fluid directs through the open end-rings 140A-B to the central inflow control device 130, where the open flow devices 170 restrict the flow of the screened fluid to the flow openings 118 in the basepipe 110.

By mounting the inflow control device 130 in this central position on the joint 50, the flow experienced by the jackets 120A-B is spread over twice the area. This can increase the life-span of the inflow control device 130 as well as its efficiency. In addition to better using the screening surface downhole, the intermediately-mounted device 130 on the joint 100 can facilitate treatment and cleanup operations. As noted above, bullheading may be used to pump treatment fluid into the borehole. The fluid is pumped down the bore 115 of the basepipe 110, through the openings 118, and out the inflow control device 130 and screens 120A-B. By having the intermediately-mounted device 130 between the screens 120A-B, the treatment fluid can be dispersed in two directions in the formation around the joint 100. This allows for better treatment of the formation and can prevent fluid loss and over-treating one area compared to others.

Another completion screen joint 100 of the present disclosure illustrated in FIGS. 4A-4E again has a basepipe 110 with two sand control jackets 120A-B disposed at each end of an intermediately-mounted inflow control device 130.

(The same reference numerals are used for similar components in the arrangement described above so their details are not repeated here.) For this joint 100, the inflow control device 130 has an arrangement of the flow devices 170 different from the above implementation.

As before, fluid can pass into the sand control jackets 120A-B from the surrounding borehole annulus, and the screened fluid can pass along the annular gaps between the sand control jacket 120A-B and the basepipe 110. Outside edges of the screen jackets 120A-B have closed end-rings 125, preventing screened fluid from passing, so that the screened fluid instead passes to the open end-rings 140A-B to enter the inflow control device 130 disposed between the jackets 120A-B.

Figure 4A:
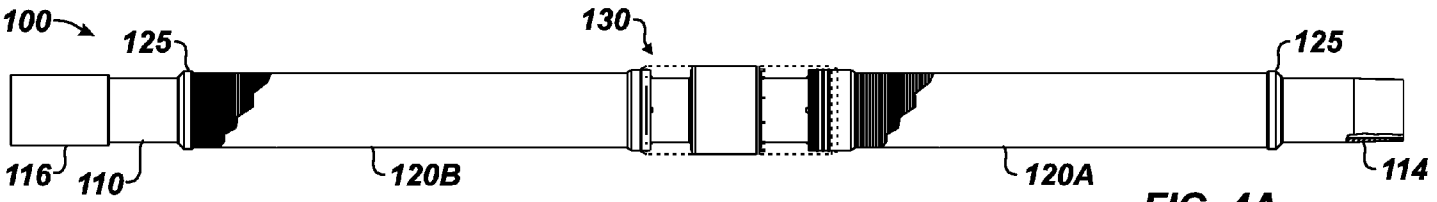
FIG. 4A illustrates another exemplary completion screen joint according to the present disclosure.
Figure 4B:
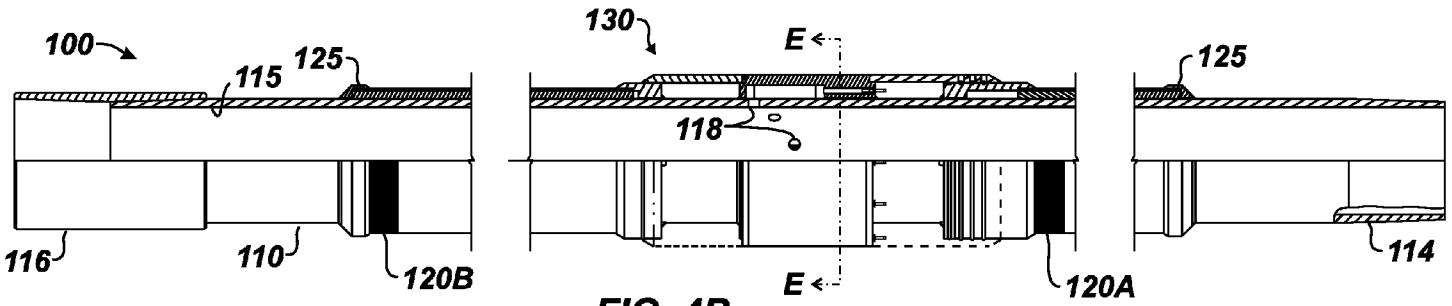
FIG. 4B illustrates the disclosed completion screen joint in partial cross-section.
Figure 4C:
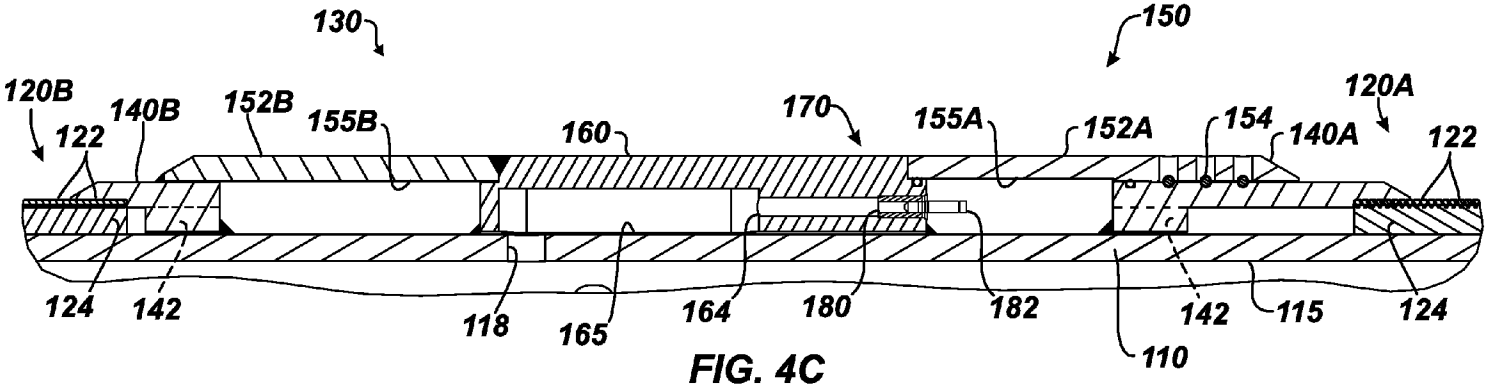
FIG. 4C illustrates a detail of an exemplary embodiment of the disclosed completion screen joint.

As best illustrated in FIG. 4C, the inflow control device 130 has the open end-rings 140A-B mentioned above and has a housing 150 disposed between them. The first end-ring 140A affixes to the basepipe 110 and abuts the inside edge of one screen jacket 120A, while the second end-ring 140B affixes to the basepipe 110 and abuts the inside edge of the other screen jacket 120B.

For its part, the housing 150 has cylindrical sleeves 152A-B and a flow ring 160 disposed about the basepipe 110. The flow ring 160 affixes to the basepipe 110, and the cylindrical sleeves 152A-B are supported on the end-rings 140A-B and the flow ring 160 to enclose two housing chambers 155A-B. One sleeve 152B can affix to the flow ring 160 and the second end-ring 140B, while the other sleeve 152A can removably fit on the flow ring 160 and end-ring 140A using lock wire 154 and seals or other mechanisms.

Being open, both end-rings 140A-B have internal channels, slots, or passages 142 that can fit partially over the inside edges of the jackets 120A-B as illustrated in FIG. 4C. During use, these passages 142 allow fluid screened by the jackets 120A-B to communicate through the open end-rings 140A-B to the housing chambers 155A-B. As also illustrated in the exposed perspective of FIG. 4D, walls or dividers 144 between the passages 142 support the open end-rings 140A-B on the basepipe 110 and can be attached to the pipe's outside surface during manufacture.

Figure 4D:
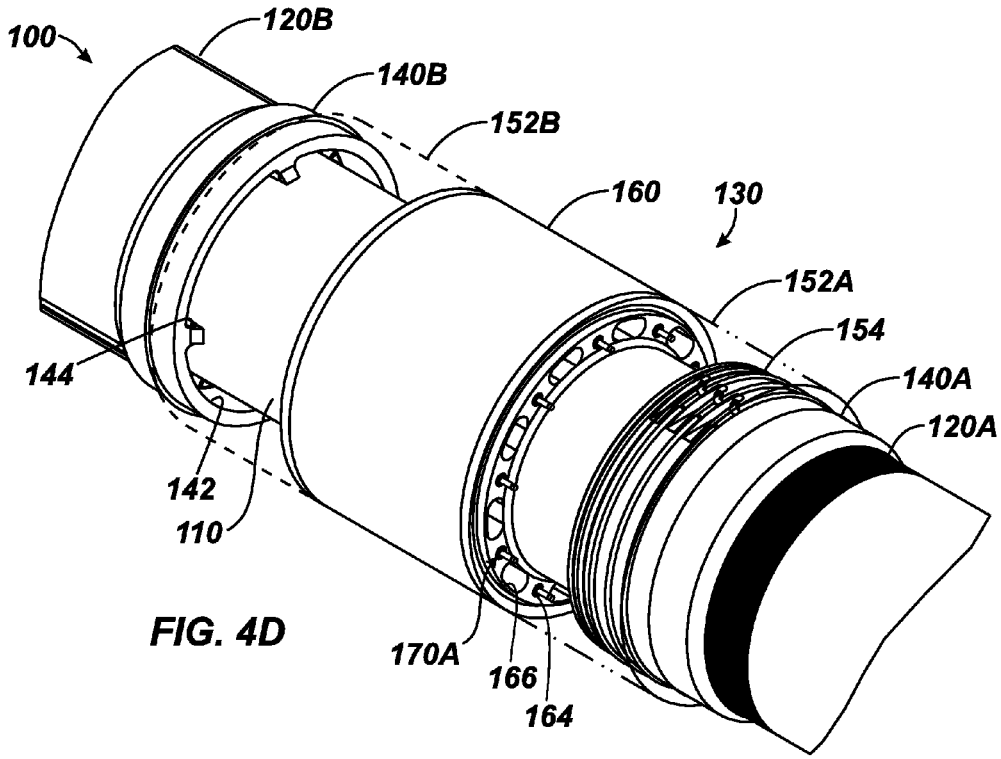
FIG. 4D illustrates a perspective view of an exemplary portion of the disclosed completion screen joint.
Figure 4E:
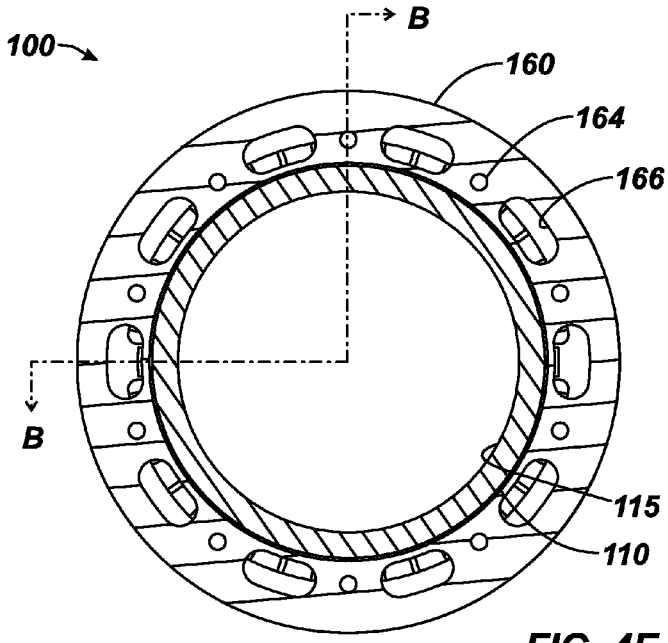
FIG. 4E illustrates an exemplary end section of the disclosed completion screen joint taken along line E-E of FIG. 4B.

FIGS. 4D-4E reveal additional details of the flow ring 160 and show how flow of screened fluids can reach the pipe's openings 118. Two types of passages are defined in the flow ring 160 for the flow of screened fluid. Cross-ports 166 disposed around the flow ring 160 communicate from one end of the flow ring 160 to the other. Meanwhile, flow ports 164 defined in between the cross-ports 166 communicate with inner chambers (165: FIG. 4C) of the flow ring 160.

During operation, the cross-ports 166 communicate the second housing chamber (155B: FIG. 4C) with the first housing chamber (155A: FIG. 4C) so that the two chambers 155A-B essentially form one chamber in the inflow control device 130. In this way, screened fluid from the second screen jacket 120B can commingle with the screened fluid from the first screen jacket 120A, and the screened fluid can communicate with the flow ports 164 exposed in the housing's first chamber 155A. In turn, each of the flow ports 164 can communicate the screened fluid to the inner chambers 165, which communicate with the basepipe's openings 118.

To configure how screened fluid can enter the basepipe 110 through the openings 118, the flow ring 160 has flow devices 170 that restrict flow of screened fluid from the housing chamber 155A to the pipe's openings 118. As before, the flow devices 170 can include a flow port, a constricted orifice, a nozzle, a tube, a syphon, or other such flow feature that controls and restricts the flow. Here, each of the flow devices 170 includes a nozzle 180 that produces a pressure drop in the flow of fluid through the flow port 164. These nozzles 180 can be configured opened or closed using pins 182 in the same manner as before.

Details of one of the nozzles 180 and the flow port 164 in the flow ring 160 are illustrated in FIG. 4C. The nozzle 180 restricts passage of the screened fluid from the first housing chamber 155A to the inner chamber 165 associated with the flow port 164. This inner chamber 165 is essentially a pocket defined in the inside surface of the flow ring 160 and allows flow from the flow port 164 to communicate with the pipe's openings 118. These pocket chambers 165 may or may not communicate with one another, and in the current arrangement, they do not communicate with each other due to the size of the cross-ports (166: FIG. 4E). Other configurations are also possible.

Similar to the arrangement described above, configuring the flow devices 170 on the inflow control device 130 of FIGS. 4A-4E involves removing the removable housing sleeve 152A and hammering or pulling pins 182 into or from selected nozzles 180. The removable housing sleeve 152A is then repositioned and held in place with the lock wire 154 so the inflow control device 130 can be used.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In the present description, the inflow control devices 130 have been disclosed as including flow devices 170 to control flow of screened fluid from the borehole to the bore of a tubing string. As to be understood herein, the inflow control devices 130 are a form of flow device and can be referred to as such. Likewise, the flow devices 170 are a form of inflow control device and can be referred to as such.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A fluid flow control apparatus for a wellbore completion comprising:

a basepipe with a bore for conveying the production fluid to the surface;

a first screen and a second screen disposed on an exterior surface of the basepipe, each of the first and second screens disposed radially apart from the basepipe so as to create a first screen flow channel between the basepipe and the first screen and a second screen flow channel between the basepipe and the second screen, the first and second screens for screening fluid flowing through the screen and into the respective first screen flow channel and second screen flow channel; and an intermediately-mounted inflow control device (ICD) positioned between the first and second screens and in fluid communication with screened fluid from the first screen flow channel and the second screen flow channel;

a housing located intermediate the first screen flow channel and the second screen flow channel, the housing creating a housing chamber annular area between an interior surface of the housing and an exterior surface of the basepipe and receiving screened fluid from each of the first screen flow channel and the second screen flow channel; and a fluid port in the basepipe for conveying screened fluid from the ICD into the basepipe bore, wherein the ICD controls the rate of screened fluid flow into the basepipe;

wherein the ICD comprises (i) a flow sleeve external to the base pipe and in fluid communication with the housing chamber annular area, and (ii) a flow device supported in the flow sleeve, the flow device controlling screened fluid flow into the fluid port in the basepipe, the flow device comprising a flow port axially aligned parallel to a long axis of the basepipe, the flow port receiving screened fluid from the flow device and conveying the screened fluid from the flow device into the basepipe fluid port.

2. The apparatus of claim 1, further comprising a flow control device for controlling screened fluid flow from at least one of the first screen flow channel and the second screen flow channel to the ICD.

3. The apparatus of claim 2, wherein the flow control device automatically selectively controls screened fluid flow from the at least one of the first screen flow channel and the second screen flow channel to the ICD.

4. The apparatus of claim 2, wherein the flow control device manually selectively controls screened fluid flow from the at least one of the first screen flow channel and the second screen flow channel to the ICD.

5. The apparatus of claim 1, wherein the housing is sealingly engaged with at least one of the first and second screens to confine screened fluid flow from the respective first screen flow channel or second screen flow channel into the housing chamber annular area between the housing and an exterior surface of the basepipe.

6. The apparatus of claim 5, wherein the sealing engagement further comprises an O-ring.

7. The apparatus of claim 1, wherein the ICD further comprises an end fitting for engaging the housing with one of the first and second sand screens, the end fitting including a fluid conduit for conveying screened fluid from the engaged sand screen flow channel into the housing chamber.

8. The apparatus of claim 1, wherein the flow sleeve supporting the flow device, the flow device controlling screened fluid flow into the fluid port in the basepipe.

9. The apparatus of claim 8, the flow sleeve supporting a flow insert, the flow insert supporting the flow device.

10. The apparatus of claim 8, wherein the flow device is responsive to a screened fluid viscosity.

11. The apparatus of claim 1, wherein the flow device is responsive to a pressure differential between fluid in the basepipe bore and screened fluid external to the flow sleeve.

12. The apparatus of claim 1, wherein the flow device is responsive to a density of the screened fluid within the housing chamber.

13. The apparatus of claim 1, wherein the ICD comprises a plurality of flow devices.

14. The apparatus of claim 1, whereby the housing is removable from the ICD.

15. The apparatus of claim 1, whereby the housing is removable from the ICD so internal components within the ICD can be configured before deployment and can be serviced or cleaned between operations.

16. A method for controlling fluid flow within a wellbore, the method comprising:

providing a basepipe within a wellbore, the basepipe including a bore for conveying the production fluid to the surface;

flowing wellbore fluid through at least one of a first screen and a second screen disposed on an exterior surface of the basepipe, the first and second screens screening particulates entrained within the wellbore fluid;

flowing screened wellbore fluid from at least one of the first screen and the second screen to a fluid port provided within the basepipe, the fluid port conveying fluid from the at least one of the first screen and second screen into the base pipe bore, positioning an inflow control device (ICD) intermediate the first screen flow channel and the second screen flow channel to receive screened fluid from the first screen and the second screen;

providing a housing intermediate the first screen flow channel and second screen flow channel to create a housing chamber annular area between an interior surface of the housing and an exterior surface of the basepipe, the ICD being positioned within the housing chamber annular area;

providing the ICD with a flow sleeve, to control screened fluid flow from the housing chamber annular area to the fluid port, and supporting the flow sleeve within the housing chamber annular area;

providing the flow sleeve with a flow device and at least one corresponding flow port, the flow port being positioned with the flow sleeve and axially aligned parallel to a long axis of the base pipe and the flow device being supported within the flow sleeve;

controlling screened fluid flow from the housing chamber annular area into the base pipe fluid port with the control device and the corresponding flow port; and flowing screened fluid from the flow device, through the flow port, then through the fluid port and into the basepipe bore.

17. The method of claim 16, further comprising positioning the ICD intermediate the first screen and second screen.

18. The method of claim 16, further comprising regulating flow into the at least one flow port using the flow device, wherein the flow device is responsive to at least one of wellbore fluid density, wellbore fluid viscosity, and wellbore fluid pressure.

19. The method of claim 16, whereby the ICD regulates fluid flow from both the first and second screens into the base pipe bore.

20. The method of claim 16, whereby the ICD regulates fluid flow from more sand screens into the base pipe bore than just the first sand screen and the second sand screen.

* * * * *